US009743751B1

(12) United States Patent
Luis et al.

(10) Patent No.: US 9,743,751 B1
(45) Date of Patent: Aug. 29, 2017

(54) ORAL HYGIENE DEVICE

(71) Applicants: René Jose Luis, Davie, FL (US); Deborah Erin Luis, Davie, FL (US)

(72) Inventors: René Jose Luis, Davie, FL (US); Deborah Erin Luis, Davie, FL (US)

( * ) Notice: Subject to any disclaimer, the term of this patent is extended or adjusted under 35 U.S.C. 154(b) by 0 days.

(21) Appl. No.: 14/943,561

(22) Filed: Nov. 17, 2015

Related U.S. Application Data

(63) Continuation-in-part of application No. 14/513,833, filed on Oct. 14, 2014, now Pat. No. 9,185,968, which is a continuation-in-part of application No. 14/023,936, filed on Sep. 11, 2013, now Pat. No. 8,857,004.

(51) Int. Cl.
*B08B 1/00* (2006.01)
*A46B 15/00* (2006.01)
*A46B 9/04* (2006.01)

(52) U.S. Cl.
CPC ..... *A46B 15/0069* (2013.01); *A46B 9/04* (2013.01)

(58) Field of Classification Search
USPC ..... 15/159.1, 167.1, 104.94
See application file for complete search history.

(56) References Cited

U.S. PATENT DOCUMENTS 405,297 A * 6/1889 Bailey ..... F41A 29/02 15/104.16
726,727 A 4/1903 Mills
860,435 A 7/1907 Bangs
1,793,307 A 2/1931 Dolan
4,911,187 A * 3/1990 Castillo ..... A46B 7/04 132/321
D350,851 S * 9/1994 Spence, Jr. ..... D24/200
6,652,279 B2 11/2003 Santacruz
(Continued)

OTHER PUBLICATIONS

EM1150072-0004 Industrial Design Application (GEKA Gmbh), Aug. 14, 2009, [online], [retrieved on May 22, 2010]. Retrieved from the Industrial Design Database of the Office for Harmonization in the Internal Market using the Internet: <URL: http://oami.europe.eu>.

*Primary Examiner* — Joseph J Hail
*Assistant Examiner* — Shantese McDonald
(74) *Attorney, Agent, or Firm* — Malloy & Malloy, P.L.

(57) ABSTRACT

An oral hygiene device, intended for discreet use by an individual, including a head portion dimensioned and configured for disposition within a user's mouth and an elongated handle structured to facilitate movement of the head into a compound rotary and reciprocal cleaning action while therein. A plurality of cleansing members secured to the outer surface of the head extend outwardly therefrom in different directions. A transferable hygienic composition may be disposed on the plurality of cleansing members and/or head and is releasable therefrom upon moistening by the user's saliva. The hygienic composition may instead be released by a chewable and/or dissolvable structure disposed on the proximate end. The head may include a curvilinear outer surface configuration cooperatively structured with a predetermined array of the plurality of cleansing members to facilitate concurrent confronting engagement with the teeth and interior of the user's mouth for cleaning and release of the hygienic composition.

11 Claims, 6 Drawing Sheets

(56) References Cited

U.S. PATENT DOCUMENTS

| | | | | |
|---|---|---|---|---|
| 6,929,475 | B1 * | 8/2005 | Dragan | A61C 5/06 401/119 |
| 6,957,958 | B2 | 10/2005 | Rowe et al. | |
| D537,254 | S | 2/2007 | Miles et al. | |
| D550,460 | S | 9/2007 | Dunn et al. | |
| D624,755 | S | 10/2010 | Luis et al. | |
| 8,584,301 | B2 | 11/2013 | Maissami | |
| 8,857,004 | B1 | 10/2014 | Luis et al. | |
| 9,185,968 | B1 | 11/2015 | Luis et al. | |
| 2002/0002753 | A1 | 1/2002 | Graham | |

* cited by examiner

ORAL HYGIENE DEVICE

CLAIM OF PRIORITY

The present application is a continuation-in-part application of previously filed, now application having Ser. No. 14/513,833, filed on Oct. 14, 2014, which is set to mature on Nov. 17, 2015 as U.S. Pat. No. 9,185,968, which also claims priority to continuation-in-part patent application having Ser. No. 14/023,936, filed on Sep. 11, 2013, which has matured into U.S. Pat. No. 8,857,004 and which is a continuation-in-part application of previously filed patent application having Ser. No. 12/898,335, filed on Oct. 5, 2010, now abandoned, the contents of which are both incorporated herein by reference in their entireties.

BACKGROUND OF THE INVENTION

Field of the Invention

This invention is directed to an oral hygiene device structured to cleanse and/or refresh the interior of the oral cavity. A head portion of the device includes a plurality of outwardly extending, flexible cleansing members having a releasable, hygienic composition disposed thereon. A handle is attached to the head for placement and manipulation thereof within the user's mouth in a manner which provides a predetermined cleansing action, wherein the handle is configured to be visually distinguishable from a conventional toothbrush and thereby be unobtrusive, when used in public.

Description of the Related Art

Good dental and oral hygiene is dependent on frequent and/or regular cleansing of the teeth, gums, etc. In accomplishing this task, an individual may use a conventionally structured toothbrush comprising an elongated, substantially rigid handle. A collection of fiber-like bristles are connected to a head having a substantially flat supporting base which facilitates the outward extension of the bristles in a substantially common direction. Such standard toothbrush structures have long been recognized as being operationally effective, at least to those individuals preferring to use a non-powered brushing instrument.

While various different sizes, shapes, etc. of known toothbrush structures are available to the public, a majority of these typically have common structural components. In addition, it is also recognized that the structural features of conventional toothbrushes promote a scrubbing or cleansing action comprising a reciprocal, back and forth or up and down motion, on the teeth, gums, etc. Also, a hygienic composition is added during the manipulation of the head and bristles in order to remove films, residues, plaque, etc. that can and do frequently build up on the teeth and gums in a relatively short period of time.

Although conventional toothbrushes of the type set forth above are prolific, in some instances they are less than desirable or acceptable. By way of example, some individuals intent on maintaining dental hygiene prefer to clean their teeth numerous times throughout a working day. However, in such situations use of a conventionally structured and designed toothbrush in a public area or in the presence of others is generally not considered to be acceptable. In addition to detracting from an individual's appearance while performing a cleansing procedure, the conventional toothbrush structure is not structurally adapted to be carried on the person of an individual on a frequent, day to day basis.

To overcome such problems and disadvantages, a variety of modified toothbrush structures and/or dental hygiene kits have been developed which attempt to facilitate more frequent cleaning of the teeth including, but not limited to, in environments where oral hygiene is not normally conducted. By way of example, collapsible or foldable toothbrush structures are known, wherein various portions thereof may interact to reduce the dimension and/or configuration thereof in order to facilitate it being more conveniently carried. However, such collapsible structures may be overly complex and less than totally reliable in terms of performing a continuously repeated, scrubbing or cleansing action on an individual's teeth. Similar disadvantages are associated with hygiene kits which may not include a conventional toothbrush instrument. Instead, known dental hygiene kits include various types of dental wipes or "finger gloves" dimensioned, configured and structured to perform at least a minimal cleansing action on the teeth and gums of an individual.

However, in both situations a separate supply of cleansing agent such as toothpaste, tooth powder or like dentifrice must be separately provided and independently carried. In order to overcome this type of disadvantage, some known, portable and/or disposable toothbrush structures incorporate a built in supply of dentifrice within the body of the cleansing instrument. As such, the integrated supply of dentifrice is supplied to the head and bristle area of the toothbrush by a pumping action or other predetermined manipulation of the device by the individual.

Based on the above, there is a long recognized need in the area of oral hygiene for an instrument which is totally self-contained, uniquely structured, and does not require a supplemental supply of cleansing agent to affect its use. Such a preferred and proposed device or instrument should preferably be capable of being used in public in a non-obtrusive manner even when other individuals are present. Moreover, the structural features of such a preferred and proposed oral hygiene device should facilitate its single use or limited use and its disposal thereafter. As a result, a preferred oral hygiene device could be carried on the person of an individual and be used in most public areas to perform a thorough and efficient cleaning of the teeth, gums and other intended portions of the oral cavity.

SUMMARY OF THE INVENTION

The present invention is directed to an oral hygiene device designed for use by an individual in a non-obtrusive manner, such as when the individual is out in public. As such, the structural features of the oral hygiene device are such as to not resemble a toothbrush or other conventional structures used to facilitate cleaning of the mouth, teeth, etc. Therefore, an individual could openly use the device in any of a number of public locations and in the presence of other individuals due at least in part to a handle portion of the device. More specifically, the handle may be dimensioned and configured to resemble a handle or "stick" of the type normally associated with "lollipop", "sucker" or other edible confectionary product.

In addition, the oral hygiene device of the present invention comprises a head having a plurality of cleansing members secured thereto and extending outwardly therefrom. Moreover, both the outer surface configuration of the head as well as a predetermined array in which the plurality of cleansing members are disposed facilitate the efficient and sometimes concurrent cleansing of the various portions of the interior of the mouth including the teeth, gums, tongue, etc. To facilitate such cleaning and provide a unique cleaning action to the head the handle is secured to the head and extends outwardly therefrom. The handle, in addition to having the above described configuration, is also of sufficient length to facilitate a combined and/or independent rotary and/or reciprocal motion thereof to accomplish confronting engagement of the plurality of cleansing members with the teeth, gums, tongue, etc. In addition, at least one embodiment of the handle includes a portion thereof, such as a free, distal end, being at least partially dimensioned and configured to facilitate its use as a "toothpick".

Additional operative features of one or more of the preferred embodiments of the present invention comprise the inclusion of a releasable hygienic composition disposed on or impregnated within at least some of the plurality of cleansing members and/or the outer surface portion of the head. Such a releasable, hygienic composition may comprise a breathe freshener, cleansing agent (toothpaste) or a combination thereof which accomplishes the hygienic goal of an individual. Therefore, an individual, while in a public area or location and in the presence of others, may serve to freshen his or her breathe and/or perform a cleaning action of the teeth, gums, etc. in a non-obvious manner. Such an unobtrusive use of the device is at least partially due to the fact that the handle significantly differs in appearance from that of a toothbrush and more closely resembles the structure of an edible, handle mounted product, as generally set forth above. As a result, it would appear that an individual would be eating or enjoying an edible confectionary product, which may be generally acceptable, rather than performing oral hygiene which is generally not done public.

More specific structural and operative features of the head of the device include an end portion which may at least partially define the outer end of the device. Moreover, the end portion of the head preferably includes a substantially hemispherical outer surface configuration. In addition, the head includes an elongated base extending between the end portion and the handle and at least partially including a curvilinear outer surface configuration. The predetermined array in which the plurality of cleansing members are disposed is intended to further facilitate the compound rotary and reciprocal cleansing action of the head once positioned in the mouth of a user. Therefore in at least one preferred embodiment, the plurality of cleansing members extend along substantially the entire hemispherical surface configuration of the end portion as well as that of the elongated, curvilinear outer surface configuration of the base portion.

The predetermined array of the plurality of cleansing members may also be accurately described as extending outwardly from the corresponding surface of the head in different directions. As a result, at least a majority of the plurality of cleansing members extend outwardly in different directions relative to one another. In such a preferred embodiment, the predetermined array of the plurality of cleansing members may also be defined by structuring and configuring the cleansing members into a plurality of transversely spaced apart rows, wherein each cleansing member of the same row or adjacent rows are disposed in spaced, segregated, non-engaging relation to one another. More specifically, each of the cleansing members may be formed of a flexible, soft, possibly resilient material, wherein each cleansing member is normally maintained in the spaced, non-engaging relation relative to others of the cleansing members until the head is disposed on the interior of the mouth of a user.

Therefore it is emphasized that the shape of the head, including that of the end portion and the base portion, as well as the configuration of the array assumed by the plurality of cleansing members, especially as operationally combined with the dimension and configuration of the handle do not represent mere design choices. Rather, these structural features are such as to facilitate the performance of the above noted compound cleaning action and the concurrent engagement of different areas of the teeth, gums, etc.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection, with the accompanying drawings in which.

Like reference numerals refer to like parts throughout the several views of the drawings.

DETAILED DESCRIPTION OF THE PREFERRED EMBODIMENT

As represented in the accompanying Figures, the present invention is directed to an oral hygiene device generally indicated as 10. As such, the structural and operative features of the device 10 facilitate the accomplishment of oral hygiene, at least in terms of breath freshening and/or cleansing in a non-obvious, unobtrusive manner, thereby facilitating the use of the device 10 in a public location and in the presence of others.

Figure 1:
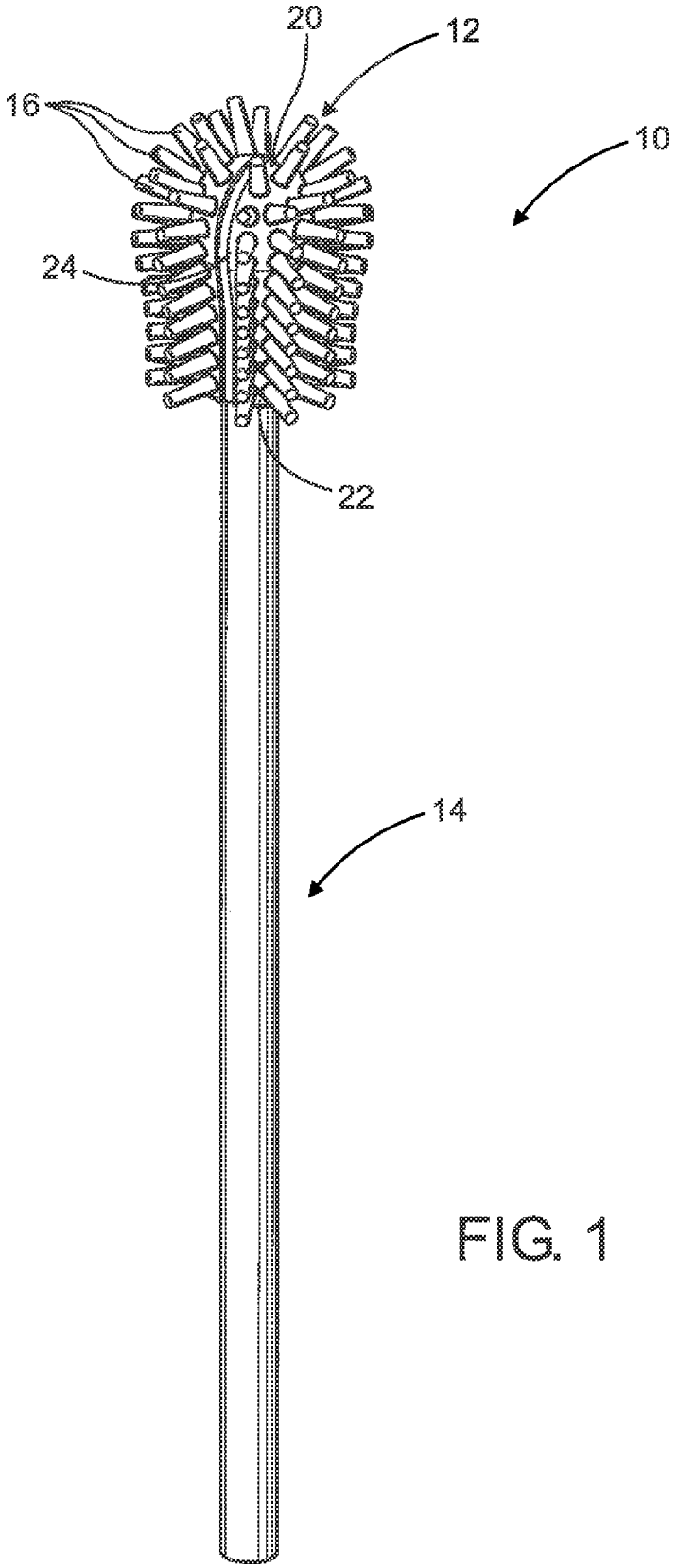
FIG. 1 is a front perspective view of a preferred embodiment of an oral hygiene device of the present invention.
Figures 2, 3, 5:
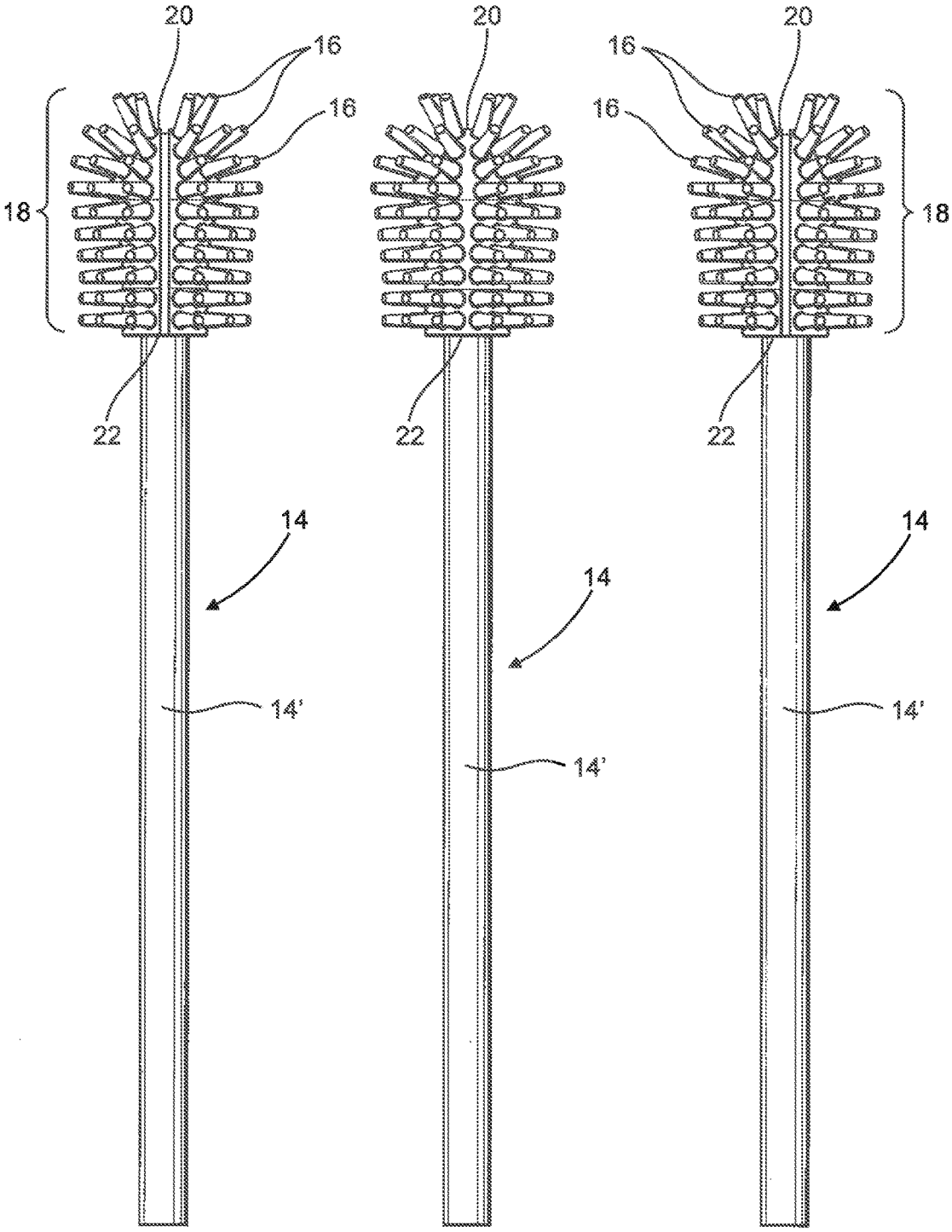
FIG. 2 is a right side view of the embodiment of FIG. 1.
FIG. 3 is a front view of the embodiment of FIGS. 1 and 2.
FIG. 5 is a rear view of the embodiment of FIGS. 1-4.
Figure 4:
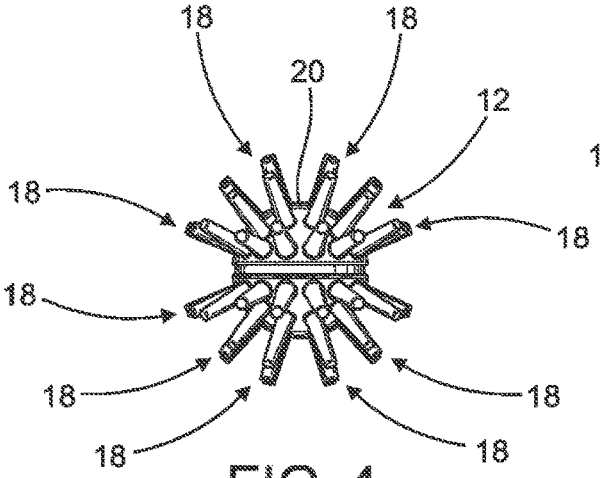
FIG. 4 is a top view of the embodiment of FIGS. 1-3.
Figure 6:
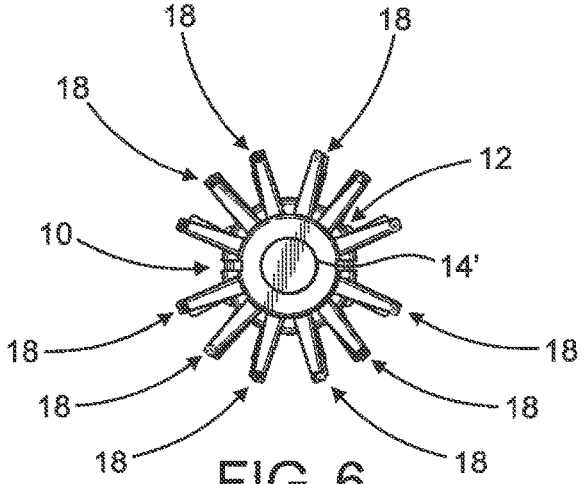
FIG. 6 is a bottom view of the embodiment of FIGS. 1-5.
Figure 7:
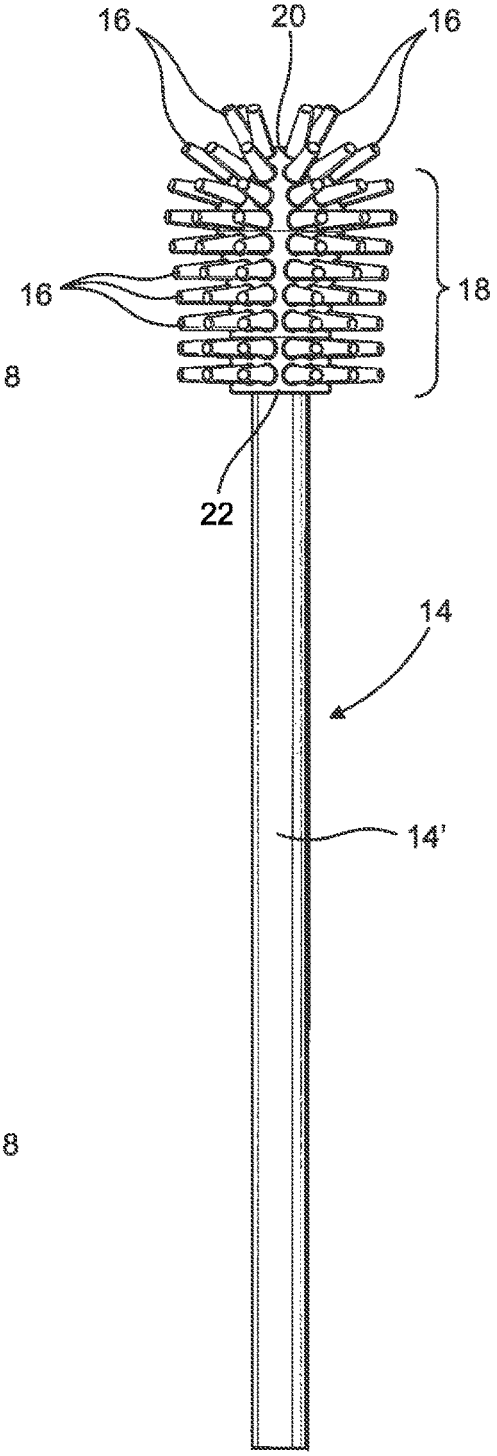
FIG. 7 is a left side view of the embodiment of FIGS. 1-6.
Figure 8:
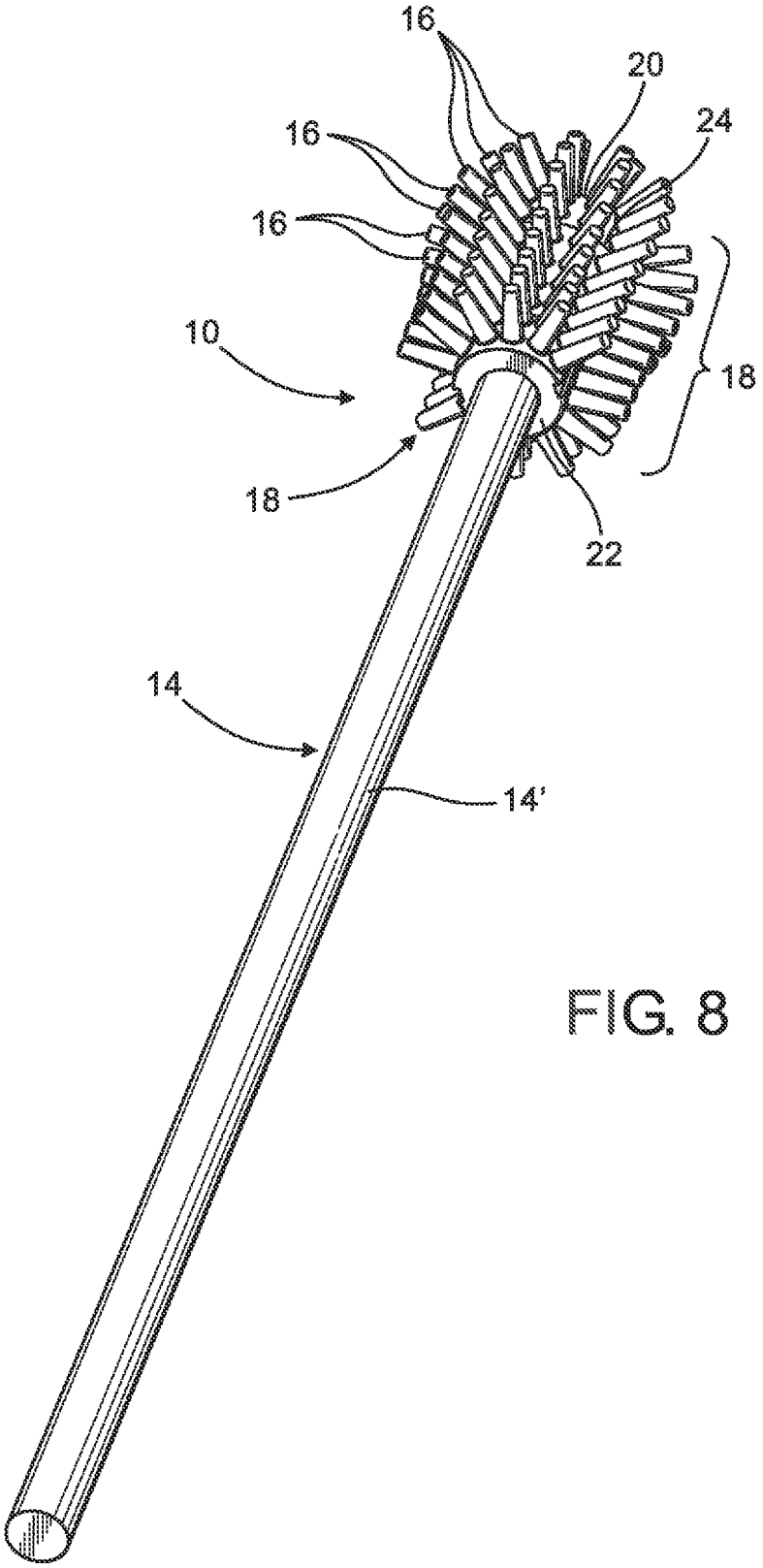
FIG. 8 is a top perspective view of the embodiment of FIGS. 1-7.

Accordingly, the device 10 comprises a head generally indicated as 12 and a handle generally indicated as 14. As also represented, the handle 14 has an elongated configuration of sufficient length to facilitate positioning of the head 12 in the mouth of an individual and the selective, predetermined manipulation of the head and plurality of cleansing members 16. More specifically and as described in greater detail hereinafter, the head 12 and the plurality of cleansing members 16 may be selectively and concurrently moved in a compound or combined reciprocal and rotary cleansing motion by exerting a combined reciprocal and twirling motion on the handle, once the head is in the user's mouth. As also represented, the handle 10 includes a substantially cylindrical configuration extending continuously along its length. Such a cylindrical configuration is more specifically defined by a circular or other curved exterior surface configuration 14' as clearly represented in FIG. 6. Therefore, the handle 14 is specifically dimensioned and configured to be visually distinguishable from the appearance of a toothbrush or other conventional hygiene product and facilitate the "twirling" motion thereof by the user. As indicated, during use the head 12 is placed within the user's mouth and moved or otherwise manipulated to accomplish the hygienic procedure, as set forth above. However, at least a portion of the length of the handle 14 will protrude from the user's mouth and may be engaged by the hand of the user. Therefore, the appearance of the oral hygiene device 10 and in particular, the handle 14, will resemble that of a handle or "stick" used to support a conventional, edible confectionary product, such as a lollipop. As a result, an individual can accomplish the hygienic procedure in public and in the presence of others in a non-obtrusive manner.

Other structural and operative features of the oral hygiene device 10 include the plurality of cleansing members 16 connected to and extending outwardly from the surface of the head 12. In at least one preferred embodiment, the plurality of cleansing members 16 are made of a flexible, soft, possibly resilient material having sufficient inherent bias to normally assume the orientation appearing throughout the Figures. The plurality of cleansing members 16 are connected to the head 12 and/or integrally formed in association with the outer surface thereof in a "predetermined array". Such predetermined array is more specifically defined by a plurality of cleansing member 16 disposed in spaced, segregated, non-engaging relation to one another prior to entering the user's mouth and confronting interior portions thereof to perform a cleansing or other hygienic procedure. The predetermined array of the plurality of cleansing members 16 may be more specifically defined by a plurality of groupings 18 of the plurality of cleansing members 16. Each grouping 18 defines a row of the plurality of cleansing members 16 extending outwardly from the head 12 in a direction which differs from the plurality of cleansing members 16 defining others of the plurality of rows 18. Accordingly, while a majority of the cleansing members 16 extend outwardly from the head 12 in different directions, many of the plurality of cleansing members 16 defining a common row 18 extend outwardly from the surface of the end 20 of the head 12 in a different direction and outwardly from the surface of the base 22 in substantially common directions, as represented in FIGS. 1-8

As a result, the predetermined array of the plurality of cleansing members 16 as generally defined above, facilitates the efficient and effective performance of the hygienic procedure once the head 12 is placed in the mouth of a user. The hygienic procedure may include brushing, scrubbing or other confronting engagement with interior portions of the mouth including the teeth, tongue, gums, etc. Further the lateral spacing between the rows 18 and the spacing between the cleansing members 16 of the same row 18 facilitates concurrent engagement with upper and lower teeth and the positioning of the cleansing members 16 between the teeth. In addition, the predetermined array in which the plurality of cleansing members 16 is collectively disposed may be further defined by their placement continuously along the outer surface of substantially the entirety of the head 12 or at least a majority thereof. More specifically, the head 12 is configured and overall structured to include an end portion 20, and a base portion 22 integrally or contiguously disposed relative to one another, as at 24.

Moreover, the end portion 20 includes a substantially hemispherical outer surface configuration. In cooperation therewith, the base portion 22 includes a substantially elongated curved or curvilinear outer surface configuration as the base portion 22 extends between and/or intermediate of the handle 14 and the end portion 20. As a result, the aforementioned predetermined array of cleansing members 16 may be further defined by each of the plurality of cleansing member 16 collectively disposed in their respective rows 18, wherein each row is of sufficient length to extend along substantially the entire hemispherical or curvilinear surface of the end portion 20 and base portion 22 respectively. Therefore it is emphasized that the aforementioned predetermined array of the plurality of cleansing members 16, as well as the specifically defined outer curved configuration of the end portion 20 and the base portion 22, are not mere design choices but are structured to facilitate performance of the hygienic procedure including the ability to accomplish a combined or compound motion and/or cleaning action when such is desired.

Additional features associated with one or more preferred embodiments of the present invention are the inclusion of one or more hygienic compositions disposed on or embedded or impregnated within at least some of a plurality of cleansing members 16 and/or the outer surface of the end portion 20 and/or base 22. Moreover, the one or more included hygienic compositions are formulated to be releasable into the mouth of the user when moistened, such as when engaging the saliva of the user. As a result, the plurality of cleansing members and/or the outer surface of the head 12 can include the hygienic composition in the form of a breath freshener, cleansing agent (toothpaste), and be in the form of a gel, paste, solution, powder or other appropriate form.

Figure 12:
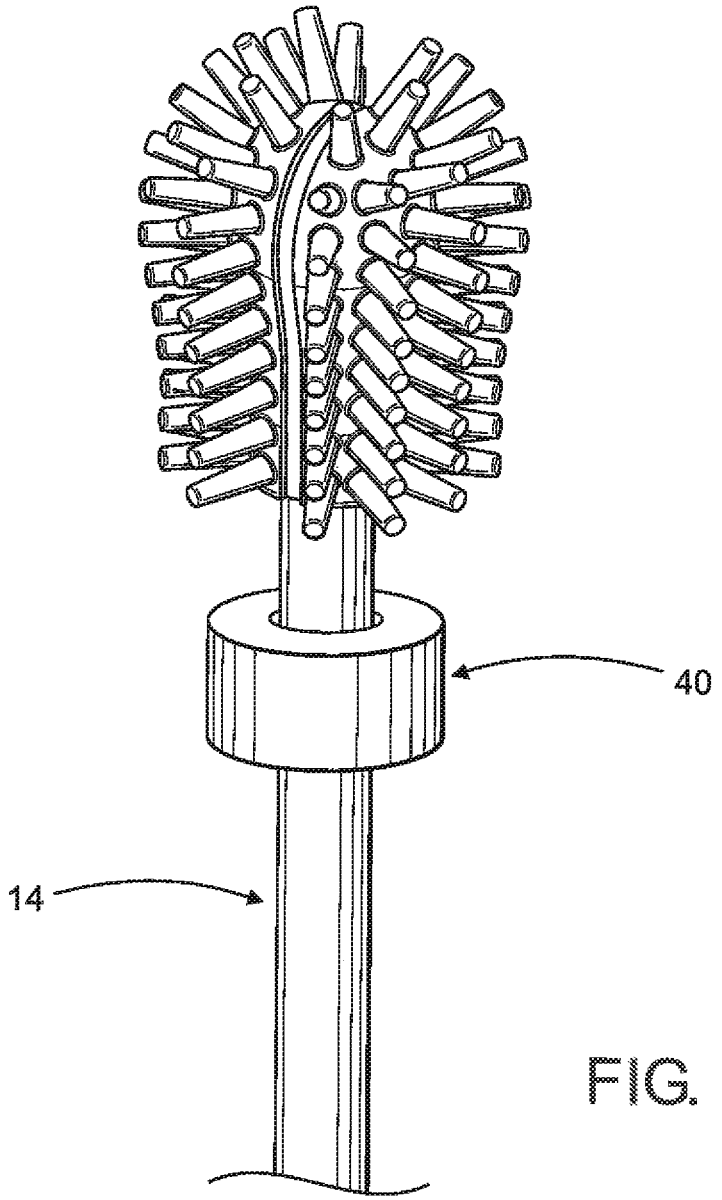
FIG. 12 is a front perspective view in partial cutaway of yet another preferred embodiment of present invention.

In one or more preferred embodiments of the present invention, as shown in FIG. 12, the hygienic composition may instead or also take the form of a cleansing element 40, a rigid or semi-rigid structure disposed on the proximate end of the handle 14. The cleansing element 40 can range in consistency from rigid, hard or solid to one that is soft, semi-rigid, pliable and/or gum-like. The cleansing element 40 is transferable, meaning it is chewable and/or formulated to dissolve when moistened, such as when engaging the saliva of the user. In any case, the cleansing element 40 releases a hygienic composition, such as xylitol and/or a breath freshener. The cleansing element 40 may include an apertured construction, such as a disc or cylinder with a hole through the middle, which fits over the proximate end of the handle 14 as shown in FIG. 12. The proximate end is that end of the invention disposed so as to allow concurrent insertion with the head 12 into the mouth of the user. The cleansing element 40 in the depicted embodiment of FIG. 12 is frictionally mounted so as to be fixed but still removable, but the cleansing element 40 may instead be mounted by any other suitably adhesive or fixing alternative.

Figure 9:
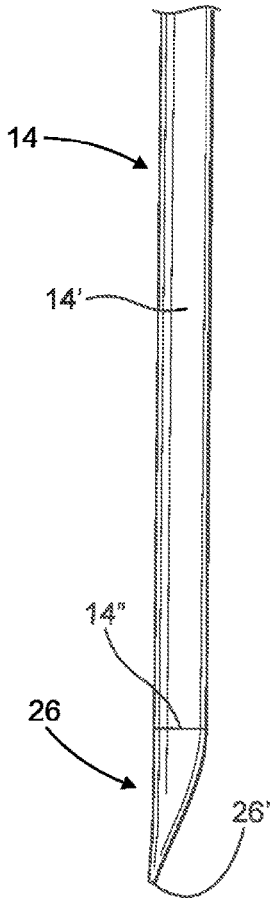
FIG. 9 is a side view in partial cutaway of yet another preferred embodiment of present invention.
Figure 10:
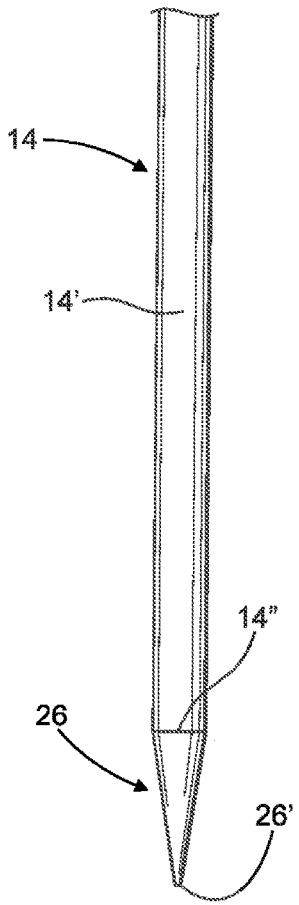
FIG. 10 is a front view in partial cutaway of the embodiment of FIG. 9.
Figure 11:
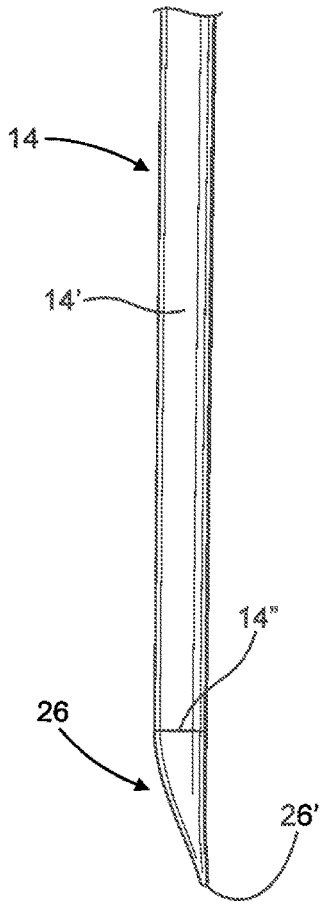
FIG. 11 is an opposite side view in partial cutaway from that represented in FIG. 9.

With primary reference to FIGS. 9-11, yet another preferred embodiment of the present invention includes the handle 14 having the cylindrically formed outer surface 14' extending along at least a majority thereof. However at least a portion of the handle 14, such as the distal end or tip is dimensioned, configured and structured to form a "toothpick" like implement generally indicated as 26. The pick structure 26 may be integrally, fixedly or removably secured to the corresponding end 14" of the handle 14. As such, when the pick structure 26 is removably attached to the end 14" it can be removed and replaced before or after use thereby further facilitating the appearance of the handle 14 as the handle or stick associated with an edible product.

In more specific terms, the pick structure 26 includes a substantially convergent configuration extending from the junction with the end 14" to the outer most extremity thereof as at 26'. As a result, the transverse or circumferential dimension of the pick structure 26 at or adjacent the extremity 26' will be sufficient to facilitate the use of the pick structure 26 in a manner similar to a conventional toothpick. However, the extremity 26' will be at least partially rounded to avoid an excessively sharp point thereat in order to avoid harm or damage to the interior of the mouth of the user.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An oral hygiene device comprising:

a head, said head being dimensioned to fit within the mouth of a user, a plurality of cleansing members extending from said head in a predetermined array, said head including an end portion and a base portion, said end portion including an outer surface configuration extending outwardly from said base, said predetermined array comprising said plurality of cleansing members arranged in a plurality of rows; at least some of said plurality of rows extending continuously along a length of said base and across said outer surface configuration of said end portion, said predetermined array further defined by said plurality of cleansing members of each of said plurality of rows extending outwardly from said end portion in different directions, said predetermined array further comprising said plurality of cleansing members of different ones of said plurality of rows extending outwardly from said elongated base in different directions, said array being structured to facilitate concurrent engagement of at least some of said cleansing members with at least one upper tooth and at least one lower tooth in the mouth of the user;

an elongated handle connected to said head and having a sufficient length to facilitate selective compound and reciprocal movement of said head and said cleansing members while in the mouth of the user;

a cleaning element dimensioned and disposed to fit within the mouth of the user, said cleaning element mounted on a proximal end of said elongated handle a predetermined distance from said head, said cleaning element formed of a solid material, dissolvable when moistened, said predetermined distance being sufficient to define a concurrent insertion of said head and said cleaning element in the mouth of the user, and a transferable hygienic composition at least partially included in said cleaning element and structured to dissolve into the mouth of the user.

2. An oral hygiene device as recited in claim 1 wherein at least some of said plurality of cleansing members include said transferable, hygienic composition disposed thereon.

3. An oral hygiene device as recited in claim 2 wherein said transferable, hygienic composition comprises a breath freshener.

4. An oral hygiene device as recited in claim 2 wherein said transferable, hygienic composition is disposed on at least some of said plurality of cleansing members prior to use.

5. An oral hygiene device as recited in claim 1 wherein said handle comprises a cylindrical configuration extending continuously along the length thereof.

6. An oral hygiene device as recited in claim 5 wherein said handle comprises a circular cross sectional configuration extending continuously along said length thereof.

7. An oral hygiene device as recited in claim 1 wherein said plurality of cleansing members of each of said plurality of rows being formed from a flexible material and being initially disposed in spaced, non-engaging relation to one another.

8. An oral hygiene device as recited in claim 1 wherein said elongated handle comprises a circular cross-sectional configuration extending along the length thereof.

9. An oral hygiene device as recited in claim 1 wherein said cleaning element is formed from an initially soft material.

10. An oral hygiene device as recited in claim 1 wherein said cleaning element is formed from an initially hard material.

11. An oral hygiene device as recited in claim 1 wherein said cleaning element is formed from an initially semi-rigid material.

* * * * *